United States Patent [19]

Luhowy

[11] 4,187,396

[45] Feb. 5, 1980

[54] VOICE DETECTOR CIRCUIT

[75] Inventor: Gabriel J. Luhowy, Lima, N.Y.

[73] Assignee: Harris Corporation, Cleveland, Ohio

[21] Appl. No.: 804,868

[22] Filed: Jun. 9, 1977

[51] Int. Cl.[2] ..... G10L 1/00

[52] U.S. Cl. ..... 179/1 SC; 179/1 P

[58] Field of Search ..... 179/1 VC, 1 P, 1 J, 179/1 SC, 1 VL; 325/478

[56] References Cited

U.S. PATENT DOCUMENTS

| | | | |
|---|---|---|---|
| 3,325,738 | 6/1967 | Busby et al. | 325/477 |
| 3,350,650 | 10/1967 | Kemper | 325/478 |
| 3,397,401 | 8/1968 | Winterbottom | 343/177 |
| 3,700,812 | 10/1972 | Springett | 179/1 P |
| 3,873,926 | 3/1975 | Wright | 325/478 |
| 3,947,636 | 3/1976 | Edgar | 179/1 D |
| 3,970,786 | 7/1976 | Randmere | 179/1 VC |
| 4,035,729 | 7/1977 | Perry | 325/478 |
| 4,044,309 | 8/1977 | Smith | 325/478 |

OTHER PUBLICATIONS

*Electronic Design,* Sep. 13, 1976, pp. 110–112, M. J. Wright, "Use Slew-Rate Filtering".

*Radio Amateur Handbook,* Apr. 1976, pp. 236, 237.

*Primary Examiner*—Felix D. Gruber

*Assistant Examiner*—E. S. Kemeny

[57] ABSTRACT

A voice detector circuit including a slew-rate limited amplifier at the input thereof so as to reduce the interference with the voice detection process caused by impulse noise. The slew-rate limited amplifier is essentially transparent to audio signals, while providing severe attenuation of impulse noise components. The actual determination of the voice content of the audio signal is provided by comparing the average syllabic-rate content of the impulse noise limited, audio signal with the peak noise content thereof. Additionally, a logarithmic amplifier is included for the purpose of optimizing the separation of the syllabic-rate envelope from the audio signal.

7 Claims, 2 Drawing Figures

VOICE DETECTOR CIRCUIT

BACKGROUND AND FIELD OF THE INVENTION

The present invention relates generally to a voice detector circuit, and more particularly to a circuit which detects the presence of a human voice in an audio signal and controls the operation of a system (such as a squelch circuit or a channel scanner) in accordance therewith.

Radio receivers commonly include circuits for determining when a modulated signal is present. Circuitry of this type is often included for the purpose of controlling a squelch gate for selectively passing the received signal to an output only when a modulated signal is present. Such circuits are also used in automatic channel-scanning radio receivers for controlling the operation of the channel scanner.

In conventional AM systems, detection of the modulated signal can be accomplished by the simple expedient of detecting the presence of the carrier signal. In single sideband systems, however, the carrier is not transmitted along with the modulated information; the presence of a modulated signal must therefore be determined by other means. A variety of systems have been devised for this purpose. Exemplary systems of this sort are described in the patents to Kemper (U.S. Pat. No. 3,350,650) and Eichenberger et al. (U.S. Pat. No. 3,102,236).

Although these circuits generally operate satisfactorily in low noise environments, it has been found that impulse noise commonly present in noise corrupted signals can interfere significantly with the operation thereof.

The present invention therefore provides a system for detecting a voice signal which includes improved noise immunity.

In accordance with the present invention, a voice detector circuit is provided which responds to an audio signal to provide an output indication of the presence or absence of a voice signal thereon. A slew-rate limited amplifier is provided at the input to a voice detector circuit for the purpose of removing impulse noise from the audio signal. The slew-rate limited amplifier is essentially transparent to ordinary audio signals, but greatly attenuates impulse noise components. The voice detector circuit operates on the impulse noise limited audio signal to provide the output indication.

In accordance with another aspect of the present invention, the voice detector circuit provides said output indication upon the basis of a comparison of the average syllabic-rate content of the audio signal with a threshold value.

BRIEF DESCRIPTION OF THE DRAWINGS

The foregoing and other objects and advantages of the present invention will become more readily apparent from the following description of a preferred embodiment, as taken in conjunction with the accompanying drawings which are a part hereof, and wherein.

DETAILED DESCRIPTION

Figure 1:
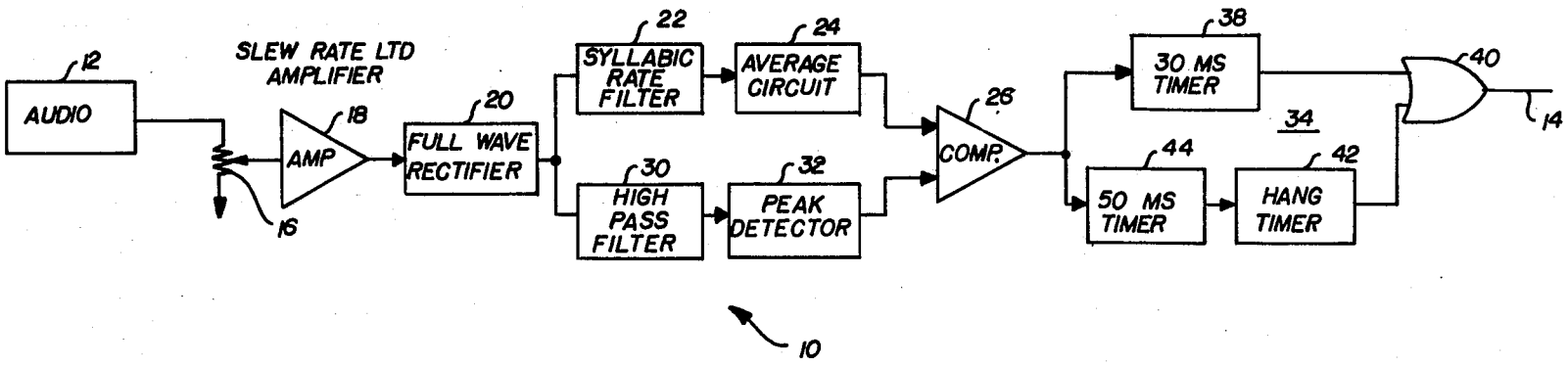
FIG. 1 is a schematic illustration of a voice detector circuit in accordance with the present invention; and, FIG. 2 is a schematic illustration of a second embodiment of a voice detector circuit in accordance with the present invention.

Referring now to the drawings, wherein the showings are for purposes of illustrating a preferred embodiment, and not for purposes of limiting the same, there is shown in FIG. 1 a voice detector circuit 10 which operates on an audio signal supplied by an audio signal source 12 to provide an output indication along an output line 14. The audio signal source may, for example, comprise a radio receiver detector section adapted to receive single side-band transmissions. Obviously, audio signal source 12 may also comprise any other source of audio signals wherein it is required to determine the voice content thereof. The output line 14 will be directed to the controlled system, for example a squelch gate or channel scanner control.

The input to voice detector 10 comprises a potentiometer 16 which is provided for the purpose of allowing adjustment of the level of the signal supplied to the remainder of the voice detector circuit. The wiper arm of potentiometer 16 is connected to an amplifier 18 having an output whose rate of change is limited. In other words, amplifier 18 is a slew-rate limited amplifier. Amplifiers of this type are described in an article entitled "Use Slew-Rate Filtering" found on pages 110 to 112 of the Sept. 13, 1976 issue of Electronic Design. The slew-rate of amplifier 18 is selected so that amplifier 18 is essentially transparent to voice signals, but is unable to follow the high peak, short duration noise pulses. Therefore, a narrow, high amplitude input square wave will be highly attenuated by slew-rate limited amplifier 18 and will appear at the output thereof as a much smaller triangular wave.

Slew-rate limited amplifier 18 is connected at its output to a full-wave rectifier 20 which full-wave rectifies the slew-rate limited signal in preparation for the detection of the syllabic envelope. A syllabic-rate filter 22 filters the full-wave rectified signal to provide an output signal indicative of the syllabic-rate content thereof. The output of syllabic-rate filter 22 is, in turn, applied to an averaging circuit 24 which averages the syllabic-rate filtered signal over time to provide an output signal having an amplitude which varies with the average amplitude of the syllabic-rate content of the audio signals. The output of averaging circuit 24 therefore indicates generally the magnitude of the voice content of the audio signal supplied to voice detector 10.

The signal supplied by averaging circuit 24 is applied to a comparator circuit 26 which compares the amplitude thereof with the amplitude of a threshold signal for the purpose of providing a hard decision regarding the presence or absence of a voice signal. In low noise situations, this threshold signal may be derived simply by means of a potentiometer. Generally, however, this threshold signal will be developed by means of a high-pass filter 30 and peak detector 32 so as to provide a threshold signal whose amplitude indicates the peak noise content of the audio signal. This approach is preferable in high noise environments because the noise content of the input signal will decrease when a modulated signal is supplied by the audio signal source 12, due to the action of the automatic gain control loop which will generally be included in audio source 12. Consequently, not only will the output of averaging circuit 24 increase, but also the output of peak detector 32 will decrease, thereby providing more rapid and positive switching by comparator 26. In any event, the output of comparator 26 will indicate whether or not the syllabic-rate content of the audio input to the voice detector circuit exceeds a predetermined amount.

The comparator output signal is supplied to a timing circuit generally indicated by reference number 34, whose purpose is to provide an output indication which does not lapse during ordinary pauses in the voice signal.

Timing circuit 34 includes a 30 millisecond timer circuit 36 which delays the actuation of the output indication provided along output line 14 until 30 milliseconds after the output of comparator 26 has begun to indicate that a voice signal is present. This delay is included to further reduce the susceptability of the voice detector circuit to impulse noise falsing. If the output of comparator 26 continuously indicates that a voice signal is present for at least 30 milliseconds, then the probability is quite high that a true voice signal has been detected. The 30 millisecond timer will therefore provide a logic "1" output indication (indicating that a voice signal has been detected) when 30 milliseconds have elapsed since the output of comparator 26 last indicated that no voice signal was present. The signal will be gated by OR gate 40 to the output line 14.

A hang-time timer 42 is provided for the purpose of preventing the indication provided along output line 14 from changing during short pauses in the voice signal. Normally, these pauses would cause the output indication to momentarily indicate that no voice signal was present. Hang-time timer 42, however, will continue to provide a logic "1" signal to OR gate 40 for a short period of time (approximately 1.2 seconds) following the conclusion of each voice segment. Although the hang-time timer 42 could be actuated by the output of 30 millisecond timer 38, it will preferably be actuated by a 50 millisecond timer 44 instead. This longer period of time (50 ms) is selected so as to more certainly assure that a voice signal has indeed been detected.

The 30 and 50 millisecond times associated respectively with timers 38 and 44 have been selected since it is a characteristic of speech waveforms that if 30 milliseconds or less of the first speech utterance is lost, the loss is almost unnoticeable. As stated previously, however, the delay of 30 milliseconds does drastically reduce the problem of impulse noise falsing. The 50 millisecond time length is selected because the probability that speech is truly present approaches 98% if an utterance lasts longer than 50 milliseconds.

Figure 2:
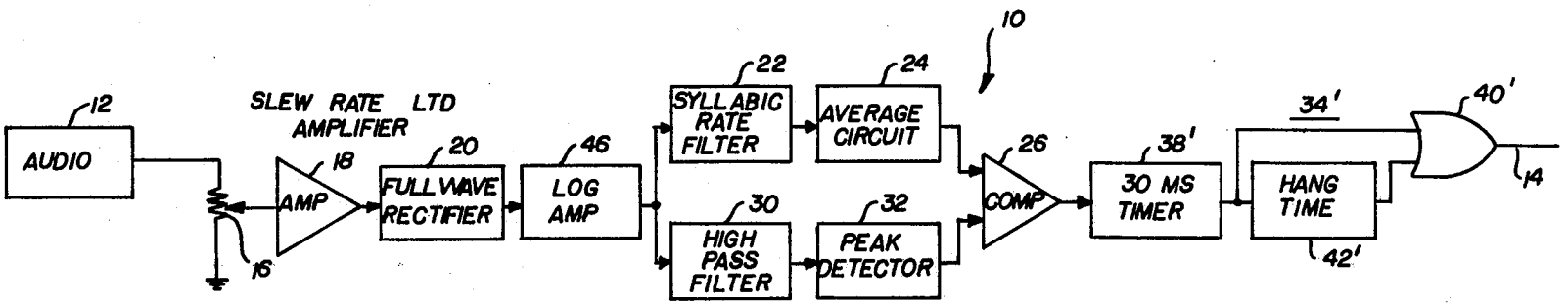

A second embodiment of the invention is shown in FIG. 2. For simplicity of description, elements of FIG. 2 which correspond to identical elements in FIG. 1 are denoted by similar reference numerals. This embodiment is quite similar to that shown in FIG. 1 except that a log amplifier 46 is interposed between the full-wave rectifier 20 on the one hand and low-pass and high-pass filters 22 and 30 on the other hand. This log amplifier is included for the purpose of simplifying the separation of the syllabic-rate envelope from the voice "carrier." This may be understood more readily when it is appreciated that the audio signal supplied to slew-rate limited amplifier 18 is essentially an amplitude modulated signal which may be characterized as a multiplicative combination of a carrier signal and a modulating signal. By including a log amp in the manner shown in FIG. 2, this multiplicative combination is changed instead to an additive combination of the carrier signal and the modulating signal. Consequently, a better signal-to-noise ratio is theoretically possible, thereby making it easier to separate the syllabic-rate envelope from the voice carrier.

FIG. 2 also illustrates a timing circuit 34' wherein the hang-time timer 42' is operated directly from the 30 millisecond timer 38', as discussed previously.

Although the invention has been described with respect to a preferred embodiment, it will be appreciated that any number of modifications may be made therein without departing from the spirit and scope of the invention as defined in the appended claims.

What is claimed is:

1. Apparatus for detecting the voice content of an audio signal, comprising slew-rate limited amplifier means responsive to said audio signal to provide an impulse noise limited audio signal, and having a maximum slew-rate selected such that said amplifier means is substantially transparent to the voice content of said audio signal, however, impulse noise components of said audio signal are substantially attenuated thereby, and voice detector means responsive to said impulse noise limited audio signal for determining the voice content of said signal and providing a first output indication thereof, wherein said voice detector means includes syllabic-rate means for determining the average syllabic-rate content of said impulse noise limited audio signal and for providing a first signal in accordance therewith, threshold means for supplying a threshold signal, and comparator means for comparing said first signal and said threshold signal for providing said first output indication having a value in accordance with said comparison.

2. Apparatus as set forth in claim 1, wherein said threshold means comprises means for detecting the peak noise content of said impulse noise limited audio signal and for supplying said threshold signal in accordance therewith.

3. Apparatus for detecting the voice content of an audio signal, comprising slew-rate limited amplifier means responsive to said audio signal to provide a noise limited audio signal, and having a maximum slew-rate selected such that said amplifier means is substantially transparent to the voice content of said audio signal, however, noise components of said audio signal are substantially attenuated thereby; and voice detector means responsive to said noise limited audio signal for determining the voice content of said signal and providing a first output indication thereof, said voice detector means including syllabic-rate means for determining the average syllabic-rate content of said noise limited audio signal and for providing a first signal in accordance therewith, threshold means for supplying a threshold signal, and comparator means for comparing said first signal and said threshold signal for providing said first output indication having a value in accordance with said comparison, wherein said syllabic-rate means includes logarithmic amplifier means responsive to said noise limited audio signal for providing a signal logarithmically related thereto for use in determining the average syllabic-rate content of said noise limited audio signal.

4. Apparatus as set forth in claim 1, wherein said voice detector means further includes first timer means for delaying said first output indication by a fixed, predetermined first delay to provide a delayed output indication, hang timer means responsive to said delayed output indication for providing a second output indication which will not lapse during momentary lapses of said delayed output indication which are shorter than a predetermined amount, and means for deriving, from said delayed output indication and said second output indication, a third output indication which will assume a predetermined state after said first delay, and which thereafter will not lapse during momentary lapses of said delayed output indication which are shorter than said predetermined amount.

5. Apparatus as set forth in claim 1, wherein said voice detector means further includes first timer means for delaying said first output indication by a first amount to provide a first delayed output indication, second timer means for delaying said first output indication by a second amount greater than said first amount, to provide a second delayed output indication, hang timer means responsive to said second delayed output indication for providing a third output indication which will not lapse during momentary lapses of said second delayed output signal, and means for deriving, from said first delayed output indication and said third output indication, a fourth output indication which will assume a predetermined state after said first delay and which, after said second delay, will not lapse during momentary lapses of said second delayed output indication.

6. Apparatus for providing an output signal indicating the voice content of an audio signal, comprising syllabic-rate means for determining the average syllabic-rate content of said audio signal and for providing a first indication in accordance with the level thereof, means for detecting the peak noise content of said audio signal and for supplying a threshold signal in accordance therewith, and comparator means for comparing said first indication with said threshold signal to provide an output indication having a value in accordance with said comparison, and further including first timer means responsive to said output indication to provide a first delayed output signal only when said output indication has had a first value continuously for a first fixed amount of time, said first value indicating that a voice signal is present in said audio signal, second timer means responsive to said output indication to provide a second delayed output signal only when said output indication has had said first value for a second fixed amount of time greater than said first fixed amount of time, hang-timer means responsive to said second delayed output signal to thereafter provide a third output signal which will not lapse during lapses of said second delayed output signal which are shorter than a third fixed amount, and means for deriving an output signal from said first delayed output signal and said third output signal, whereby said hangtimer will not be activated until after said delay of said second fixed amount after said output indication.

7. Apparatus for detecting the voice content of an audio signal, comprising slew-rate limited amplifier means responsive to said audio signal to provide an impulse noise limited signal, said amplifier having a maximum slew-rate selected such that said amplifier means is substantially transparent to the voice content of said audio signal, however impulse noise components of said audio signal are substantially attenuated thereby, syllabic-rate detector means responsive to said impulse noise limited signal for providing a first signal indicative of the syllabic-rate content of said impulse noise limited signal, noise detector means for providing a second signal indicative of the noise content of said audio signal, and comparator means for comparing said first and second signals to provide an output signal having a value dependent upon the results of said comparison.

* * * * *